United States Patent [19]

Miyamoto et al.

[11] Patent Number: 4,613,525

[45] Date of Patent: Sep. 23, 1986

[54] INK-JET RECORDING MEDIUM

[75] Inventors: Shigehiko Miyamoto, Kamagaya; Takeshi Yamasaki, Funabashi, both of Japan

[73] Assignee: Mitsubishi Paper Mills Ltd., Tokyo, Japan

[21] Appl. No.: 784,480

[22] Filed: Oct. 4, 1985

[30] Foreign Application Priority Data

Dec. 7, 1984 [JP] Japan ..... 59-258760

[51] Int. Cl.[4] ..... B41M 5/00

[52] U.S. Cl. ..... 427/256; 346/1.1; 346/135.1; 427/261; 428/195; 428/211; 428/341; 428/342; 428/537.5; 428/688; 428/697; 428/702

[58] Field of Search ..... 346/135.1, 1.1; 427/261, 256; 428/195, 207, 211, 341, 342, 457, 464, 537.5, 688, 697, 702

[56] References Cited

U.S. PATENT DOCUMENTS

| | | | |
|---|---|---|---|
| 4,371,582 | 2/1983 | Sugiyama et al. | 346/135.1 |
| 4,446,174 | 5/1984 | Maekawa et al. | 346/135.1 |
| 4,496,629 | 1/1985 | Haruta et al. | 428/211 |

*Primary Examiner*—Bruce H. Hess

*Attorney, Agent, or Firm*—Cushman, Darby & Cushman

[57] ABSTRACT

An ink jet recording medium containing a hydrotalcite compound is disclosed. This recording medium can provide recorded images excellent in waterproofness and light fastness by jetting thereonto a water-base ink containing a water soluble dye.

8 Claims, No Drawings

INK-JET RECORDING MEDIUM

BACKGROUND OF THE INVENTION

This invention relates to a medium for recording by means of an ink and, more particularly, to an ink-jet recording medium excellent in the density of recorded images and characters, in the ink absorbency, and in the durability of recorded images.

The ink-jet recording system provides the recording of images and characters by causing tiny ink droplets to fly on various working principles and to adhere to a recording medium such as paper. This system is coming in wide use as a means for recording a variety of patterns including "kanji" (chinese-derived characters) and color images because of high speed, low noise, simplicity in multicolor recording, versatility of recorded patterns, and, in addition, no need of development nor fixing. It is also possible by the multicolor ink-jet system to obtain a recorded image comparable favorably to that obtained by multicolor printing using a printing plate or by color photography. For this reason, the multicolor ink-jet system is now being widely adapted even to the field of full-color image recording, because this system affords a recorded image at a lower cost compared with the photographic process in the use field where the required number of copies is small enough.

In the ink-jet recording system, efforts have been made on the part of equipment and ink composition so that coated and non-coated paper commonly used for general printing or writing purposes may be used as the recording medium. However, with the improvement or refinement in the performance of equipment and the enlargement in use field, such as increase in running speed of equipment, refinement of equipment, and full-color recording, it has become necessary for the recording medium to have higher characteristics such as higher density and brighter or more brilliant tone of ink dots; improved ink absorbency to prevent the ink dots from running or feathering even when ink dots have been overlapped; more controlled lateral diffusion of ink dots so that each ink dot may have smooth and not blurred contour. It is further required that when exposed to ultraviolet light, atmospheric oxygen or moisture, the fastness of dyes in the ink is not deteriorated but preferably is increased.

To answer the above requirements, several proposals have been made. For instance, Japanese Patent Application "Kokai" (Laid-open) Nos. 53,012/77 and 49,113/78 have disclosed respectively an ink-jet recording paper comprising a low-sized base paper impregnated with a surface coating composition and that comprising a paper sheet containing an internally added urea-formaldehyde resin powder and impregnated with a water-soluble polymer. These ink-jet recording paper sheets of the plain paper type rapidly absorb an ink, but have disadvantages of blurred dot contour and low dot density.

Japanese Patent Application "Kokai" (Laid-open) Nos. 5,830/80, 51,583/80, and 11,829/80 have disclosed respectively an ink-jet recording paper sheet provided with an ink absorptive coating layer on a base substrate; examples of said coating layer containing a non-colloidal silica powder as pigment; and examples of coated paper carrying a coating of two-layer structure in which the ink absorption speed is different from each other. These inkjet recording paper sheets of the coated type are improved in dot diameter, dot shape, dot density, and color tone reproducibility as compared with those of the plain paper type, but the inks used for those recording sheets are in most cases water-based inks employing a water-soluble dye and, as a consequence, when the image formed on the recording medium is exposed to water, the dye tends to be leached out of the image, resulting in marked decrease of the record value. To overcome these difficulties, there have been disclosed in Japanese Patent Application "Kokai" (Laid-open) No. 53,591/80 examples of applying a water-soluble metal salt to the recording surface; in No. 84,992/81 examples of recording media containing a polycationic polyelectrolyte in the surface; in No. 150,396/80 a method of applying onto the ink-jet record a water-proofing agent capable of forming a lake with the dye in ink dots; and in No. 58,869/81 a method which comprises forming an ink-jet record on a recording medium carrying a coating layer of a water-soluble polymer and then insolubilizing the water-soluble polymer to effect water proofing treatment. These water-proofing methods, however, have a disadvantage of either insufficient waterproofing effect or decreased durability of the dye owing to some reaction between the water-proofing agent and the dye. As a consequence, it has been quite difficult to establish sufficient water-proofness and light fastness at the same time.

For the purpose of improving the light fastness, there have been disclosed in Japanese Patent Application "Kokai" (Laid-open) Nos. 68,303/79, 85,804/79, and 18,151/81 examples in which ultraviolet absorbers are incorporated into the ink. These UV absorbers, however, present problems such as decreased stability of the ink jet and insufficient effect of the addition in small amounts. As an alternative solution of the problem, it has been proposed to incorporate UV absorbers such as a benzophenone type or a benzotriazole type into the ink-jet recording sheet, as disclosed in Japanese Patent Application "Kokai" (Laid-open) Nos. 74,192/82, 74,193/82, and 87,988/82. Such a method, however, has disadvantages of insufficient effect on the light fastness and low efficiency of UV absorbers owing to limited solubility of UV absorbers in water.

SUMMARY OF THE INVENTION

An object of this invention is to provide an ink-jet recording medium which is improved in ink-jet printing properties, excellent in water-proofness and light fastness of the image formed with a water-base ink, and especially improved in resistances against light and discoloration of water-soluble black dyes and/or water-soluble magenta dyes.

DETAILED DESCRIPTION OF THE INVENTION

This invention is an ink-jet recording medium upon which a record image is formed by use of a water-base ink containing a water-soluble dye, which is characterized by containing a hydrotalcite compound.

The term "hydrotalcite compound", as used herein, means a compound having a chemical composition of magnesium aluminum hydroxy carbonate hydrate and a crystal structure such that d values of the highest peak, the second highest peak, and the third highest peak are 7.89, 3.91, and 2.60, respectively, as determined by the method of X-ray diffraction. Although available as a natural product, hydrotalcite is also commercially available as a synthetic product from Kyowa Kagaku Kogyo Co.; as examples, there may be mentioned Kyowaad ® 500 [$Mg_6Al_2(OH)_{16}CO_3.4H_2O$]; Kyowaad ® 1100 [$Mg_{4.5}Al_2(OH)_{13}CO_3.mH_2O$ (m=3 to 3.5)]; Alcamac ®, a pharmaceutical grade; and DHT-4A (aluminum magnesium carbonate hydrate), a surface-treated product.

The recording medium according to this invention is produced in the following manner.

In forming a wet web on a paper making machine from a slurry of disintegrated pulp fiber, a hydrotalcite compound is added to the pulp slurry and formed into the wet web; or the formed sheet is impregnated or coated, by means of a size press or the like, with a coating composition containing a hydrotalcite compound suspended therein. It is also possible to coat a suitable substrate with a coating composition containing a hydrotalcite compound, by means of a common coater, thereby to form an ink receptive layer. In the sheet making or coating, it is further possible to use, in addition to the hydrotalcite compound, other common additives such as fillers, pigments, binders, and the like. If it is necessary to impart waterproofness to the recorded image, a cationic resin can be added. In the present invention, it is even desirable to use the cationic resin in order to improve both the waterproofness and the light fastness.

The amount of the hydrotalcite compound to be added has no special limitation, but preferably is 2–30 parts by weight per 100 parts by weight of pulp for plain papers, and from synthetic silica 98 parts by weight: hydrotalcite compound 2 parts by weight to synthetic silica 65 parts by weight: hydrotalcite compound 35 parts by weight for coated papers.

As examples of fillers or pigments which can be used in this invention, mention may be made of white pigments such as ground limeston, kaolin, talc, calcium sulfate, barium sulfate, titanium dioxide, zinc oxide, zinc sulfide, zinc carbonate, titanium white, aluminum silicate, diatomaceous earth, calcium silicate, magnesium silicate, synthetic amorphous silica, aluminum hydroxide, alumina, and lithopone; and organic pigments such as styrene-base plastic pigments, acrylic-base plastic pigments, microcapsules, and urea resin pigments. Of these pigments particularly preferred are synthetic amorphous silica and aluminum hydroxide.

The cationic resins, as herein referred to, include monomers, oligomers, or polymers which exhibit cationic properties upon dissociation when dissolved in water, preferably those compounds represented by the following formulas (I) to (VI).

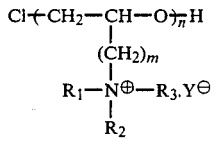

(I)

wherein $R_1$, $R_2$, and $R_3$ represent each an alkyl group, m is 1 to 7, n is 2 to 10, and Y represents an acid group.

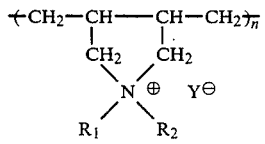

(II)

-continued

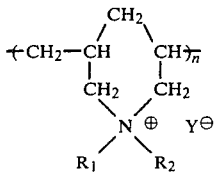

(III)

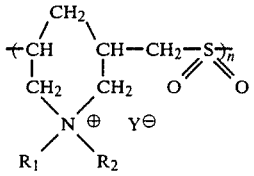

(IV)

In the above formulas (II) to (IV), $R_1$ and $R_2$ represent each $—CH_3$, $—CH_2—CH_3$, or $—CH_2—CH_2—OH$ and Y represents an acid group.

Polyalkylenepolyamine dicyandiamide ammonium salt condensates. (V)

Examples of compounds represented by the formula (I) include Nalpoly-607 (Nalco Chemical Co.) and Polyfix 601 (Showa High Polymer Co.).

The compounds represented by the formulas (II) to (IV) are polydiallylamine derivatives formed by the cyclization polymerization of diallylamine compounds. Examples are Parcol 1697 (Allied Colloid Co.), Cat Floc (Calgon Corp.), PAS (Nitto Boseki Co.), and Neofix RPD (Nikka Kagaku Co.). An example of the compound represented by the formula (V) is Neofix RP-70 (Nikka Kgaku Co.). The amount used of the cationic resins represented by the formulas (I) to (V) is generally 0.1 to 4 g/m$^2$, preferably 0.2 to 2 g/m$^2$.

As examples of binders suitable for use in this invention, mention may be made of oxidized starch, etherified starch; cellulose derivatives such as carboxymethylcellulose and hydroxyethylcellulose; casein, gelatin, soybean protein, polyvinyl alcohol and derivatives thereof, maleic anhydride resin; latices of conjugated diene-base polymers such as common styrene-butadiene copolymer and methyl methacrylate-butadiene copolymer; latices of acrylic polymers such as polymers or copolymers of acrylate esters or methacrylate esters; latices of vinyl polymers such as ethylene-vinyl acetate copolymers; latices of functional-group modified polymers, which are polymers modified by using a monomer having a functional group such as carboxyl group; water-base binders comprising thermosetting synthetic resins such as melamine resins and urea resins; and synthetic resin-type binders such as polymethyl methacrylate, polyurethane resins, unsaturated polyester resins, vinyl chloride-vinyl acetate copolymer, polyvinylbutyral, and alkyd resins. These binders are used each alone or in combinations. The binders are used in an amount of 2 to 120, preferably 5 to 50, parts for 100 parts of the pigment. Although such proportions are not critical so long as the amount of binder is sufficient for binding together the pigment particles, yet it is undesirable to use more than 120 parts of the binder, because the excessive amount causes the deterioration of porous structure of the recording medium or extremely diminishes the porosity.

If necessary, it is possible to incorporate other additives such as pigment dispersants, thickeners, flow modulators, defoamers, foaming suppressors, release agents, blowing agents, penetrants, coloring dyes, coloring pigments, fluorescent whiteners, ultraviolet absorbers, antioxidants, preservatives, antifungal agents, and waterproofing agents.

As base substrates, use may be made of sheet materials such as paper sheets and thermoplastic films. The paper sheet may be either unsized or properly sized and either filled or unfilled. The thermoplastic film may be either transparent such as polyester, polystyrene, polyvinyl chloride, methyl methacrylate, acetylcellulose, polyethylene, or polycarbonate film, or opaque white film filled with a white pigment or containing finely subdivided foam. Examples of white pigments used to fill the film include titanium dioxide, calcium sulfate, calcium carbonate, silica, clay, talc, and zinc oxide among many others. It is further possible to use as the base substrate a so-called laminated paper sheet comprising a paper sheet overlaid with a resin film or coated with a molten resin. The surface of the base substrate can be provided with a subbing layer or treated with corona discharge to improve adhesion of an ink receptive layer to the support.

A coated sheet prepared by coating a base substrate with an ink receptive layer can be used as such for recording, or after having been imparted with surface smoothness by passing through the nip of rolls of a supercalender or gloss calender under application of heat and/or pressure. The extent of calendering is sometimes limited, because excessive calender treatment tends to decrease the intergranular void, resulting in a decrease in ink absorbency.

The water-base ink, as herein referred to, is a recording fluid comprising undermentioned coloring agents, a liquid vehicle, and additives.

The coloring agents suitable for use include water soluble dyes such as direct dyes, acid dyes, basic dyes, reactive dyes, and food colors.

Examples of direct dyes:

C.I. Direct Black 2, 4, 9, 11, 14, 17, 19, 22, 27, 32, 36, 38, 41, 48, 49, 51, 56, 62, 71, 74, 75, 77, 78, 80, 105, 106, 107, 108, 112, 113, 117, 132, 146, 154, 194

C.I. Direct Yellow 1, 2, 4, 8, 11, 12, 24, 26, 27, 28, 33, 34, 39, 41, 42, 44, 48, 50, 51, 58, 72, 85, 86, 87, 88, 98, 100, 110

C.I. Direct Orange 6, 8, 10, 26, 29, 39, 41, 49, 51, 102

C.I. Direct Red 1, 2, 4, 8, 9, 11, 13, 17, 20, 23, 24, 28, 31, 33, 37, 39, 44, 46, 47, 48, 51, 59, 62, 63, 73, 75, 77, 80, 81, 83, 84, 85, 90, 94, 99, 101, 108, 110, 145, 189, 197, 220, 224, 225, 226, 227, 230

C.I. Direct Violet 1, 7, 9, 12, 35, 48, 51, 90, 94

C.I. Direct Blue 1, 2, 6, 8, 15, 22, 25, 34, 69, 70, 71, 72, 75, 76, 78, 80, 81, 82, 83, 86, 90, 98, 106, 108, 110, 120, 123, 158, 163, 165, 192, 193, 194, 195, 196, 199, 200, 201, 202, 203, 207, 218, 236, 237, 239, 246, 258

C.I. Direct Green 1, 6, 8, 28, 33, 37, 63, 64

Direct Brown 1A, 2, 6, 25, 27, 44, 58, 95, 100, 101, 106, 112, 173, 194, 195, 209, 210, 211

Examples of acid dyes:

C.I. Acid Black 1, 2, 7, 16, 17, 24, 26, 28, 31, 41, 48, 52, 58, 60, 63, 94, 107, 109, 112, 118, 119, 121, 122, 131, 155, 156

C.I. Acid Yellow 1, 3, 4, 7, 11, 12, 13, 14, 17, 18, 19, 23, 25, 29, 34, 36, 38, 40, 41, 42, 44, 49, 53, 55, 59, 61, 71, 72, 76, 78, 99, 111, 114, 116, 122, 135, 161, 172

C.I. Acid Orange 7, 8, 10, 33, 56, 64

C.I. Acid Red 1, 4, 6, 8, 13, 14, 15, 18, 19, 21, 26, 27, 30, 32, 34, 35, 37, 40, 42, 51, 52, 54, 57, 80, 82, 83, 85, 87, 88, 89, 92, 94, 97, 106, 108, 110, 115, 119, 129, 131, 133, 134, 135, 154, 155, 172, 176, 180, 184, 186, 187, 243, 249, 254, 256, 260, 289, 317, 318

C.I. Acid Violet 7, 11, 15, 34, 35, 41, 43, 49, 75

C.I Acid Blue 1, 7, 9, 22, 23, 25, 27, 29, 40, 41, 43, 45, 49, 51, 53, 55, 56, 59, 62, 78, 80, 81, 83, 90, 92, 93, 102, 104, 111, 113, 117, 120, 124, 126, 145, 167, 171, 175, 183, 229, 234, 236

C.I. Acid Green 3, 12, 19, 27, 41, 9, 16, 20, 25

C.I. Acid Brown 4, 14

Examples of basic dyes:

C.I. Basic Black 2, 8

C.I. Basic Yellow 1, 2, 11, 12, 14, 21, 32, 36

C.I. Basic Orange 2, 15, 21, 22

C.I. Basic Red 1, 2, 9, 12, 13, 37

C.I. Basic Violet 1, 3, 7, 10, 14

C.I. Basic Blue 1, 3, 5, 7, 9, 24, 25, 26, 28, 29

C.I. Basic Green 1, 4,

C.I. Basic Brown 1, 12

Examples of reactive dyes:

C.I. Reactive Black 1, 3, 5, 6, 8, 12, 14

C.I. Reactive Yellow 1, 2, 3, 13, 14, 15, 17

C.I. Reactive Orange 2, 5, 7, 16, 20, 24

C.I. Reactive Red 6, 7, 11, 12, 15, 17, 21, 23, 24, 35, 36, 42, 63, 66

C.I. Reactive Violet 2, 4, 5, 8, 9

C.I. Reactive Blue 2, 5, 7, 12, 13, 14, 15, 17, 18, 19, 20, 21, 25, 27, 28, 37, 38, 40, 41, 71

C.I. Reactive Green 5, 7

C.I. Reactive Brown 1, 7, 16

Examples of food colors:

C.I. Food Black 2

C.I. Food Yellow 3, 4, 5

C.I. Food Red 2, 3, 7, 9, 14, 52, 87, 92, 94, 102, 104, 105, 106

C.I. Food Violet 2

C.I. Food Blue 1, 2

C.I. Food Green 2, 3

The liquid vehicles of water-base inks are water and various water-soluble organic solvents. As examples of water-soluble organic solvents, mention may be made of alkyl alcohols of 1 to 4 carbon atoms such as methyl alcohol, ethyl alcohol, n-propyl alcohol, isopropyl alcohol, n-butyl alcohol, sec-butyl alcohol, tert-butyl alcohol, and isobutyl alcohol; amides such as dimethylformamide and dimethylacetamide; ketones or ketoalcohols such as acetone and diacetone alcohol; ethers such as tetrahydrofuran and dioxane; polyalkylene glycols such as polyethylene glycol and polypropylene glycol; alkylene glycols having 2 to 6 alkylene groups such as ethylene glycol, propylene glycol, butylene glycol, triethylene glycol, 1,2,6-hexanetriol, thiodiglycol, hexylene glycol, and diethylene glycol; and lower alkyl ethers of polyhydric alcohols such as glycerol, ethylene glycol methyl ether, diethylene glycol methyl (or ethyl) ether, and triethylene glycol monomethyl ether. Of these various water-soluble organic solvents, especially preferred are polyhydric alcohols such as diethylene glycol and lower alkyl ethers of polyhydric alcohols such as triethylene glycol monomethyl ether and triethylene glycol monoethyl ether.

Examples of other additives are pH controlling agents, metal chelating agents, antifungal agents, viscosity controlling agents, surface tension controlling agents, wetting agents, surface active agents, and rust preventives.

When an image is recorded with a water-base ink containing a water-soluble dye on a recording medium incorporated with a hydrotalcite compound according to this invention, the recorded image is improved in light fastness. Although the reason for this is yet to be elucidated, it seems that the hydrotalcite compound catches the liberated free acid or suppresses the free radical generation or makes the generated free radical unstable and short-lived, thus eliminating the accelerating effect of the free acid or free radical upon the fading and discoloration of dyes.

The adaptability to ink-jet recording was tested in the following manner.

Light fastness: Solid images are printed with each of the inks of cyan (C), magneta (M), yellow (Y), and black (Bk) colors by means of an ink-jet printer (Type A-1210 of Canon Inc.). The image is exposed to light source in a Xenon Fademeter (Type FAL-25X-HCL of Suga Shikenki Co.) under the conditions: 40° C., 60% RH, 41 W/m$^2$ illumination, 40 hours. The color densities before and after the exposure are measured by McBeth Densitometer RD 514. The percentage ratio of the color density after exposure to that before exposure is expressed in terms of light fastness (percent retention).

Fading and discoloration: These are estimated by visually evaluating the degree of reddening of the black image after exposure in the above test.

Waterproofness: Solid images are printed with each of the inks of C, M, Y, and Bk colors by means of the same ink-jet printer as used above. The image bearing recording medium is immersed for 3 minutes in running water at 30° C. and the density is measured by means of McBeth Densitometer RD 514. The percentage ratio of the color density after immersion to that before immersion is expressed in terms of waterproofness. A higher value corresponds to better waterproofness.

Rate of ink absorption: A solid image is printed with a red (magneta+yellow) ink by means of an ink-jet printer of Sharp Corp. or Canon Inc. Immediately (about 1 second) after the printing the recording sheet is sent forward to come into contact with a touch roll or a human finger tip to inspect the staining.

The invention is illustrated in detail below with reference to Examples, but the invention is not limited thereto. In Examples all parts and percentages are by weight.

EXAMPLE 1

To a pulp slurry comprising 70 parts of hardwood bleached kraft pulp having a freeness of 350 ml (csf) and 30 parts of softwood bleached kraft pulp having a freeness of 400 ml (csf), was added 10 parts of a synthetic hydrotalcite (Kyowaad KW-1100 of Kyowa Kagaku Co.) having a chemical composition $Mg_{4.5}Al_2(OH)_{13}CO_3.mH_2O$ (m=3-3.5), followed by 0.01 part of an anionic high-molecular retention aid. The resulting mixture was made into a paper sheet, 68 g/m$^2$ in basis weight, on a Fourdrinier paper machine. A size solution comprising 5% of an oxidized starch (MS 3800 of Nippon Shokuhin Kako Co.) and 2% of a cationic resin (Neofix RP-70 of Nikka Kagaku Co.) was fed to the paper sheet at an application rate of 50 g/m$^2$ on wet basis by means of a size press equipment provided in the line of paper-making machine. The sized sheet was finished in a customary manner to obtain a recording paper. The results of test for the adaptability to ink-jet recording were as shown in Table 1.

EXAMPLE 2

To a pulp slurry comprising 70 parts of hardwood bleached kraft pulp having a freeness of 350 ml (csf) and 30 parts of softwood bleached kraft pulp having a freeness of 400 ml (csf), were added 10 parts of talc, 2 parts of a cationic resin (Epinox 130 of Dick-Hercules Co.), and 0.01 part of an anionic high-molecular retention aid. The resulting mixture was made into a paper sheet, 74 g/m$^2$ in basis weight, on a Fourdrinier paper machine. A size solution comprising 3 parts of polyvinyl alcohol (PVA 117 of Kuraray Co.) and 6 parts of a synthetic hydrotalcite (Kyowaad KW-500 of Kyowa Kagaku Co.) having a chemical composition $Mg_6Al_2(OH)_{16}CO_3.4H_2O$, the solids content being 9%, was fed to the paper sheet at an application rate of 60 g/m$^2$ on wet basis by means of a size press equipment provided in the line of paper machine. The sized sheet was finished in a customary manner to obtain a recording paper. The results of test for the adaptability to ink-jet recording were as shown in Table 1.

COMPARATIVE EXAMPLE 1

The procedure of Example 2 was repeated, except that a 3% polyvinyl alcohol solution was used for the size solution. The results of test for the adaptability to ink-jet recording were as shown in Table 1.

TABLE 1

| Recording paper | Item of test: Rate of ink absorption | Fading and discoloration (Bk) | Light fastness (%) M | C | Y | Bk | Waterproofness (%) M | C | Y | B |
|---|---|---|---|---|---|---|---|---|---|---|
| Example 1 | o | o | 69 | 100 | 100 | 100 | 111 | 104 | 111 | 104 |
| Example 2 | o | o | 72 | 100 | 100 | 96 | 71 | 118 | 130 | 109 |
| Comparative Example 1 | o | x | 26 | 100 | 75 | 74 | 72 | 116 | 121 | 110 |

Note:
"o" means "Good" and "x" means "Bad".

EXAMPLES 3 TO 8

A base paper, 68 g/m$^2$ in basis weight, was made on a Fourdrinier paper machine from a slurry comprising 80 parts of hardwood bleached kraft pulp having a freeness of 370 ml (csf), 20 parts of softwood bleached kraft pulp having a freeness of 400 ml (csf), 13 parts of powdered limestone, 1 part of cationic starch, 0.08 part of an alkylketone dimer sizing agent (Hercon W of Dick-Hercules Co.), and a polyalkylenepolyamine-epichlorohydrin resin. In making the base paper, an oxidized starch was fed to the base paper by means of a size press equipment at a coverage of 2 g/m$^2$ on dry basis to obtain a coat base paper having a Stöckigt sizing degree of 21 seconds. A coating composition was prepared from X parts of a synthetic silica (Syloid 74 of Fuji-Davison Co.), Y parts of a synthetic hydrotalcite (Kyowaad KW-500 of Kyowa Kagaku Co.), X and Y being as shown in Table 2, 40 parts of polyvinyl alcohol (PVA 117 of Kuraray Co.), 5 parts of a cationic resin (Polyfix 601 of Showa Kobunshi Co., and a small amount of a defoamer, the solids content being 18%. The coat base paper was overcoated with said coating composition at a coverage of 12 g/m$^2$ on dry basis by means of an air-knife coater, and dried. The resulting paper was mildly supercalendered to obtain a recording paper. The results of test for adaptability to ink-jet recording were as shown in Table 2.

EXAMPLE 9

A coating composition of 17% solids content was prepared from 65 parts of a synthetic silica (Mizukasil P-73 of Mizusawa Kagaku Co.), 35 parts of a synthetic hydrotalcite (Kyowaad KW-1100 of Kyowa Kagaku Co.), 40 parts of polyvinyl alcohol (PVA 105 of Kuraray Co.), 20 parts of another polyvinyl alcohol (PVA 117 of Kuraray Co.), and a small amount of a defoamer. The coating composition was coated on the aforementioned coat base paper with an air-knife coater at a coverage of 9 g/m$^2$ on dry basis, then dried, and mildly supercalendered to obtain a recording paper. The results of test for adaptability to ink-jet recording were as shown in Table 2.

COMPARATIVE EXAMPLE 2

A coating composition of 17% solids content was prepared from 100 parts of a synthetic silica (Finesil X-37 of Tokuyama Soda Co.), 30 parts of a polyvinyl alcohol (PVA 117 of Kuraray Co.), and a small amount of a defoamer. The coating composition was coated on the aforementioned coat base paper with an air-knife coater at a coverage of 12 g/m$^2$ on dry basis, then dried, and mildly supercalendered to obtain a recording paper. The results of test for adaptability to ink-jet recording were as shown in Table 2.

COMPARATIVE EXAMPLE 3

The procedure of Example 9 was repeated, except that 35 parts of a synthetic silica (Syloid 404 of Fuji Devison Co.) was used in place of the synthetic hydrotalcite and 5 parts of a cationic resin (Neofix RP-70 of Nikka Kagaku Co.) was added. The results of test for adaptability to ink-jet recording were as shown in Table 2.

TABLE 2

| Recording paper | Synth. silica X parts | Synth. hydrotalcite Y parts | Rate of ink absorption | Fading and discoloration (Bk) | Light fastness (%) M | C | Y | Bk | Waterproofness (%) M | C | Y | Bk |
|---|---|---|---|---|---|---|---|---|---|---|---|---|
| Example 3 | 98 | 2 | o | o | 82 | 100 | 95 | 90 | 95 | 99 | 96 | 96 |
| Example 4 | 95 | 5 | o | o | 83 | 100 | 96 | 92 | 96 | 99 | 96 | 97 |
| Example 5 | 90 | 10 | o | o | 83 | 100 | 95 | 94 | 95 | 99 | 94 | 95 |
| Example 6 | 80 | 20 | o | o | 84 | 100 | 95 | 94 | 95 | 100 | 95 | 96 |
| Example 7 | 70 | 30 | o | o | 85 | 100 | 95 | 96 | 93 | 99 | 94 | 93 |
| Example 8 | 60 | 40 | o | o | 86 | 100 | 96 | 96 | 94 | 100 | 93 | 94 |
| Example 9 | 65 | 35 | o | o | 91 | 100 | 97 | 94 | 13 | 69 | 108 | 39 |
| Comparative Example 2 | 100 | — | o | x | 70 | 93 | 96 | 76 | 1 | 49 | 0 | 13 |
| Comparative Example 3 | 100 | — | o | x | 51 | 89 | 85 | 77 | 95 | 100 | 77 | 97 |

Note:
"o" means "Good" and "x" means "Bad".

It is confirmed that the recording media obtained in Examples 1 to 9, which contain a hydrotalcite compound according to this invention, are excellent in all characteristics required for the adaptability to ink-jet recording and exhibit remarkable improvement particularly in light fastness and resistances to fading and discoloration of magneta (M) and black (Bk) which are especially inferior in these resistances.

What is claimed is:

1. An ink jet recording medium for forming a recorded image using a water-base ink containing a water soluble dye wherein the recording medium contains in or on an ink receptive layer a hydrotalcite compound having the chemical composition of magnesium aluminum hydroxy carbonate hydrate and a crystal structure such that the d values of the highest peak, the second highest peak and the third highest peak are 7.89, 3.91, and 2.60, respectively, as determined by the method of X-ray diffraction.

2. An ink jet recording medium according to claim 1 which additionally contains a cationic resin.

3. An ink jet recording medium according to claim 2 wherein the cationic resin is selected from the following (I) to (V):

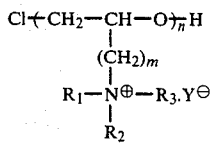

(I)

wherein $R_1$, $R_2$, and $R_3$ represent each an alkyl group, m is 1 to 7, n is 2 to 10, and Y represents an acid group.

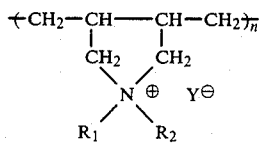

(II)

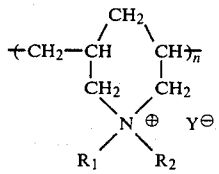

(III)

-continued

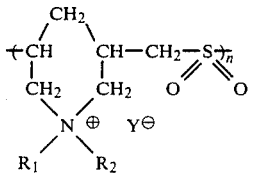

(IV)

(In the above formulas (II) to (IV), $R_1$ and $R_2$ represent each $—CH_3$, $—CH_2—CH_3$, or $—CH_2—CH_2—OH$ and Y represents an acid group) and Polyalkylenepolyamine dicyandiamide ammonium salt condensates. (V)

4. An ink jet recording medium according to claim 2 wherein the content of the cationic resin is 0.1 to 4 $g/m^2$.

5. An ink jet recording medium according to claim 1 wherein the water soluble dye is a direct dye, acid dye, basic dye, reactive dye or food color.

6. An ink jet recording method which comprises jetting a water-base ink onto the recording medium of claim 1.

7. An ink jet recording medium according to claim 1 wherein the hydrotalcite compound is present only in the ink receptive layer.

8. An ink jet recording medium according to claim 1 wherein the hydrotalcite compound is present only on the ink receptive layer.

* * * * *